US006004912A

United States Patent [19]

Gudeman

[11] Patent Number: 6,004,912

[45] Date of Patent: Dec. 21, 1999

[54] VAPOR PHASE LOW MOLECULAR WEIGHT LUBRICANTS

[75] Inventor: Christopher Scott Gudeman, Los Gatos, Calif.

[73] Assignee: Silicon Light Machines, Sunnyvale, Calif.

[21] Appl. No.: 09/092,220

[22] Filed: Jun. 5, 1998

[51] Int. Cl.[6] ..... C10M 129/04; G02B 5/18

[52] U.S. Cl. ..... 508/577; 508/583; 134/31; 134/37; 359/290; 359/291; 359/224; 359/572

[58] Field of Search ..... 134/31, 37; 508/577, 508/583

[56] References Cited

U.S. PATENT DOCUMENTS

| | | | |
|---|---|---|---|
| 5,311,360 | 5/1994 | Bloom et al. | 359/572 |
| 5,331,454 | 7/1994 | Hornbeck | 359/224 |
| 5,412,186 | 5/1995 | Gale | 219/679 |
| 5,482,564 | 1/1996 | Douglas et al. | 134/18 |
| 5,512,374 | 4/1996 | Wallace et al. | 428/422 |
| 5,523,878 | 6/1996 | Wallace et al. | 359/290 |
| 5,576,878 | 11/1996 | Henck | 359/224 |
| 5,602,671 | 2/1997 | Hornbeck | 359/224 |
| 5,610,438 | 3/1997 | Wallace et al. | 257/682 |
| 5,841,579 | 11/1998 | Bloom et al. | 359/572 |

OTHER PUBLICATIONS

Buhler et al., "Linear Array of Complementary Metal Oxide Semiconductor Double–Pass Metal Micromirrors," Optical Engineering, vol. 36, No. 5, pp. 1391–1398, May 1997.

Russick et al., "Supercritical Carbon Dioxide Extraction of Solvent from Micromachine Structures," Supercritical Fluids—Extraction and Pollution Prevention, vol. 670, pp. 255–268, 1997.

Hackh's Chemical Dictionary, Fourth Edition, pp. 7,249, 255, 302, 303, 362, 424, 719–721, 1969.

*Primary Examiner*—Ellen M. McAvoy
*Attorney, Agent, or Firm*—Haverstock & Owens LLP

[57] ABSTRACT

An improved micro machine has at least a first element which is moveable relative to a second element such that the first and second elements can be in contact with each other. The contacting portions of both the first and second elements are protected with a long-lasting lubricant to prevent the elements from sticking or adhering to each other. The lubricant is a polar low molecular weight compound preferably applied as a vapor. This class of low molecular weight lubricants consists of acetone, ethanol, ethylene glycol, glycerol, isopropanol, methanol, and water. According to the disclosure a lubricant has a low molecular weight if its molecular weight is less than ~100 amu, or has a vapor pressure ≧5 Torr at room temperature. The preferred micro machine is a GLV wherein the bottom of the deformable ribbon contacts the landing electrode when the reflector is in a down position (close to the substrate). By applying any one of these low molecular weight lubricants in their gas phase to the contacting portions of the deformable ribbon and the landing electrode, these contacting portions will not weld, adhere, or stick together over a period of cycles. The lubricant is applied by bubbling an inert gas through a liquid reservoir of the lubricant and flowing the resultant vapor over the micro machine.

20 Claims, 8 Drawing Sheets

VAPOR PHASE LOW MOLECULAR WEIGHT LUBRICANTS

FIELD OF THE INVENTION

The invention relates to micro machine devices and a method for creating these devices. More particularly, the present invention relates to micro machine devices which have moveable elements which engage a different element wherein the point of engalgement may have a tendency to stick or adhere. The present invention relates to lubricants which prevent, or reduce this tendency.

BACKGROUND OF THE INVENTION

There have been recent developments in the miniaturization of various electromechanical devices also known as micro machines. From this push to miniaturize, the field of diffraction gratings or now commonly referred to as grating light valves has emerged. An example of a GLV is disclosed in U.S. Pat. No. 5,311,360 which is incorporated in its entirety herein by reference. According to the teachings of the '360 patent, a diffraction grating is formed of a multiple mirrored-ribbon structure such as shown in FIG. 1. A pattern of a plurality of deformable ribbon structures 100 are formed in a spaced relationship over a substrate 102. Both the ribbons and the substrate between the ribbons are coated with a light reflective material 104 such as an aluminum film. The height difference that is designed between the surface of the reflective material 104 on the ribbons 100 and those on the substrate 102 is $\lambda/2$ when the ribbons are in a relaxed, up state. If light at a wavelength $\lambda$ impinges on this structure perpendicularly to the surface of the substrate 102, the reflected light from the surface of the ribbons 100 will be in phase with the reflected light from the substrate 102. This is because the light which strikes the substrate travels $\lambda/2$ further than the light striking the ribbons and then returns $\lambda/2$, for a total of one complete wavelength $\lambda$. Thus, the structure appears as a flat mirror when a beam of light having a wavelength of $\lambda$ impinges thereon.

By applying appropriate voltages to the ribbons 100 and the substrate 102, the ribbons 100 can be made to bend toward and contact the substrate 102 as shown in FIG. 2. The thickness of the ribbons is designed to be $\lambda/4$. If light at a wavelength $\lambda$ impilnges on this structure perpendicularly to the surface of the substrate 102, the reflected light from the surface of the ribbons 100 will be completely out of phase with the reflected light from the substrate 102. This will cause interference between the light from the ribbons and light from the substrate and thus, the structure will diffract the light. Because of the diffraction, the reflected light will come from the surface of the structure at an angle $\Theta$ from perpendicular.

In formulating a display device, one very important criteria is the contrast ratio between a dark pixel and a lighted pixel. The best way to provide a relatively large contrast ratio is to ensure that a dark pixel has no light. One technique for forming a display device using the structure described above, is to have a source of light configured to provide light with a wavelength $\lambda$ which impinges the surface of the structure from the perpendicular. A light collection device, e.g., optical lenses, can be positioned to collect light at the angle $\Theta$. If the ribbons for one pixel are in the up position, all the light will be reflected back to the source and the collection device will receive none of the light. That pixel will appear black. If the ribbons for the pixel are in the down position, the light will be diffracted to the collection device and the pixel will appear bright.

Experimentation has shown that the turn-on and turn-off voltages for GLV ribbons exhibit hysteresis. FIG. 3 shows a brightness versus voltage graph for the GLV. The vertical axis represents brightness and the horizontal axis represent voltage. It will be understood by those of ordinary skill in the art that if diffracted light is collected, when the GLV ribbon is up and at rest, that the minimum of light is collected. When the GLV ribbon is down, the maximum of light is collected. In the case where the ribbon is able to move downwardly by exactly $\lambda/4$ of the wavelength of the anticipated light source, then the light collected in the down position with the ribbon firmly against the substrate is truly at a maximum.

Upon initial use, the GLV remains in a substantially up position while at rest, thereby diffracting no light. To operate the GLV, a voltage is applied across the ribbon 100 (FIG. 1) and the underlying substrate 102. As the voltage is increased, almost no change is evident until a switching voltage $V_2$ is reached. Upon reaching the switching voltage $V_2$, the ribbon snaps fully down into contact with the substrate. Further increasing the voltage will have negligible effect on the optical characteristics of the GLV as the ribbon 100 is fully down against the substrate 102. Though the ribbon is under tension as a result of being in the down position, as the voltage is reduced the ribbon does not lift off the substrate until a voltage $V_1$ is reached. The voltage $V_1$is lower than the voltage $V_2$. This initial idealized operating characteristic is shown by the solid line curve 106 in FIG. 3.

The inventors discovered that the GLV devices exhibited aging. It was learned that operating the GLV over an extended period of time caused the release voltage to rise toward the switching voltage $V_2$. Additionally, the amount of diffracted light available for collection also decreased as the release voltage increased. Experience led the inventors to realize that the GLV devices were fully aged after about one hour of continuously switching the GLV between the up and relaxed state to the down and tensioned state. These experiments were run at 10,000 Hz. Though those previous inventions worked as intended, this change in release voltage and the degradation of the diffracted light made such GLV devices unsuitable as commercial production products.

FIG. 4 shows an actual graph for the amount of light versus voltage for a control GLV device operated in an ambient atmosphere. A series of five curve traces are shown, 108, 110, 112, 114 and 116. Each of the traces is taken at a different point diring the aging cycle, trace 108 being recorded first in time, and then each successive trace recorded at a later point in the aging cycle. FIG. 4 shows the voltage applied both positively and negatively. What the traces of FIG. 4 show is that after the ribbon 100 (FIG. 1) is forced into the down position against the substrate 102 at a voltage $V_2$, reducing the applied voltage will cause the amount of the collected diffracted light to diminish until the release voltage $V_1$ is reached. This phenomenon is likely reached as the edges of the ribbon 100 begin to rise. However, as long as at least a portion of the ribbon 100 remains in contact with the substrate 102, a significant portion of the light is diffracted and hence available for collection.

It is apparent from FIG. 4 that each recorded successive trace 110, 112, 114 and 116 shows that the release voltage $V_1$ continues to rise and concurrently the amount of collected diffracted light decreases. FIG. 5 is a corresponding graph to FIG. 4 and shows the switching voltage $V_2$ and the release voltage $V_1$ during the aging process. The voltage levels are shown on the vertical axis and time is shown in the horizontal axis. FIG. 5 shows that the switching voltage $V_2$ remains fairly stable during the aging process. However, FIG. 5 also shows that the release voltage $V_1$ rises during the aging cycle.

Analysis of GLVs after the completion of the aging cycle shows that structures build between the ribbon surface and the underlying substrate. FIG. 6 schematically shows that structures can develop on the bottom of a ribbon 120 while the substrate 122 remains relatively unchanged. FIG. 7 schematically shows that structures can develop on the top of the substrate 124 while the bottom of a ribbon 126 remains relatively unchanged. FIG. 8 schematically shows that structures can develop on the bottom of a ribbon 128 and also on the top of the substrate 130. As the irregularities 132 develop, the ribbons 120, 126 and 128 are prevented from moving all the way down onto the substrate 122, 124 and 130, respectively. The irregularities prevent the ribbons from moving $\lambda/4$ of the anticipated wavelength of incident light. Hence, incomplete diffraction into collection optics results and the maximum light level achievable is reduced.

It is believed that the irregularities grow as a result of the contact between the GLV ribbon and the substrate. The ribbon impacts the substrate at relatively high rate of speed. Upon contact of the ribbon onto the substrate, the surfaces join together in a welding-like process. As the surfaces release from one another, a portion of one of the surfaces releases forming a raised irregularity on the surface to which the welded structure remains adhering. Over time this process continues until the irregularity negatively impacts the operation of the structure.

As shown in FIG. 9, in operation, the GLV ribbon preferably is toggled into the down state by increasing the voltage above the switching voltage $V_S$. Then the voltage is lowered to and maintained at a biasing voltage $V_B$. To raise the GLV ribbon to the up state, the voltage is lowered below the release voltage $V_R$. The voltage is then raised and maintained at the biasing voltage $V_B$. In this way no change in optical characteristics occurs by changing the voltage to the biasing voltage $V_B$, yet the amount of voltage necessary to change the state of the GLV ribbon is a small pulse in either direction. Unfortunately, as the release voltage changes, such operation can become unstable.

The assignee of this application has developed another GLV technology called the flat GLV. That technology is disclosed in U.S. patent application Ser. No. 08/482,188, filed Jun. 7, 1995, entitled Flat Diffraction Grating Light Valve and invented by David M. Bloom, Dave B. Corbin, William C. Banyai and Bryan P. Staker. This application is allowed and will issued on Nov. 24, 1998 as U.S. Pat. No. 5,841,579. This patent document is incorporated herein by reference. All the same problems associated with aging also apply to the flat GLV technology.

What is needed is a solution that prevents the surfaces of two elements which contact each other in a GLV from adhering or sticking to each other and thereby prevent the formation of irregularities therebetween. Additionally, a method is needed for carrying out the solution in a manufacturing process of the GLV.

SUMMARY OF THE INVENTION

The present invention is an improved micro machine. This improved micro machine has at least a first element which is moveable relative to a second element such that the first and second elements can be in contact with each other. The contacting portions of both the first and second elements are protected with a long-lasting lubricant to prevent the elements from sticking or adhering to each other.

In the preferred embodiment of the present invention, a new class of polar low molecular weight lubricants is applied while in the gas phase in a manner to include the contacting portions of the elements within a micro machine to reduce wear of the contacting portions and prevent degradation of performance. This class of polar low molecular weight lubricants comprising: acetone, ethanol, ethylene glycol, glycerol, isopropanol, methanol, and water. According to the invention, a lubricant has a polar low molecular weight if its molecular weight is less than ~100 amu, or has a vapor pressure $\geqq 5$ Torr at room temperature.

In the preferred embodiment, the micro machine is a GLV wherein the bottom of the deformable ribbon contacts the landing electrode when the reflector is in a down position (close to the substrate). By applying any one of these polar low molecular weight lubricants in their gas phase to the contacting portions of the deformable ribbon and the landing electrode, these contacting portions will not weld, adhere, or stick together over a period of cycles.

This improved micro machine is shown in its preferred embodiment to be a GLV. However, other micro machine can benefit from these novel lubricants for preventing connected surfaces from welding to each other and also from the method of applying such lubricants to contact surfaces during a manufacturing process.

DETAILED DESCRIPTION OF THE INVENTION

In general, the present invention was developed for use with an improved micro machine namely GLVs. Note that the present invention can also be used in conjunction with other types of micro machines wherein there is contact between surfaces.

According to the preferred embodiment of the present invention a lubricant is provided between the contact surfaces of a GLV ribbon and the underlying substrate. The lubricant prevents the formation of irregularities. This prevents the release voltage from rising and also prevents a concurrent degradation in light intensity. Further, in at least one manufacturing process of GLV devices, the facing surfaces of the ribbon and or the substrate are initially rough. When the lubricant is present, the rough surface is peened down by repeated contact and the hysteresis initially improves until the surfaces are smoothed.

Figure 10:
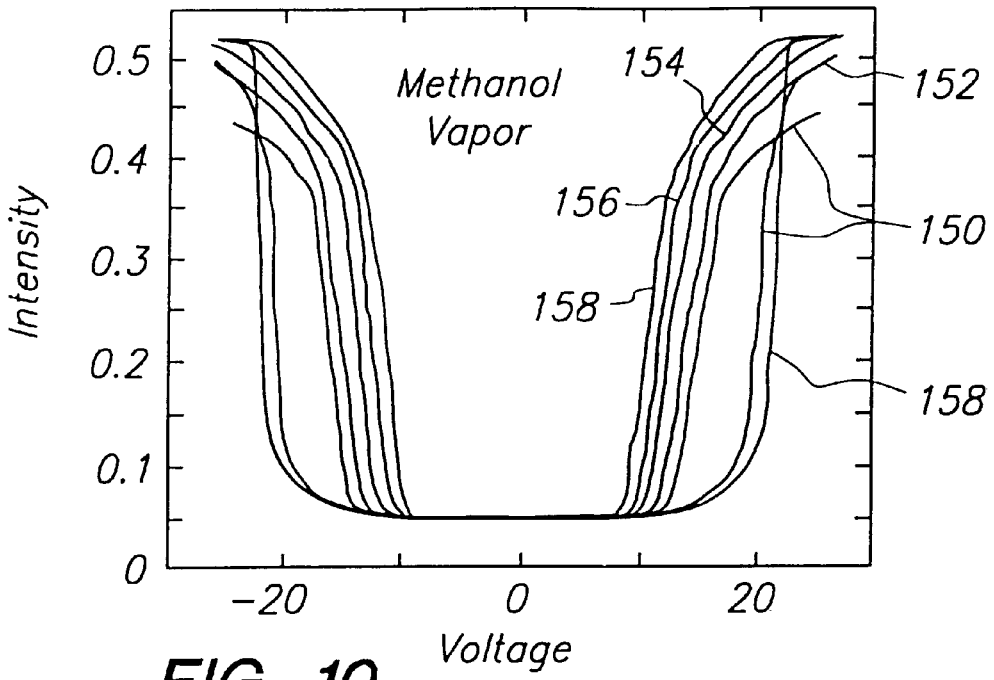
FIG. 10 is a graph representing experimental values of collected light versus voltage applied in a GLV over a course of an aging cycle with methanol as a lubricant.
Figure 11:
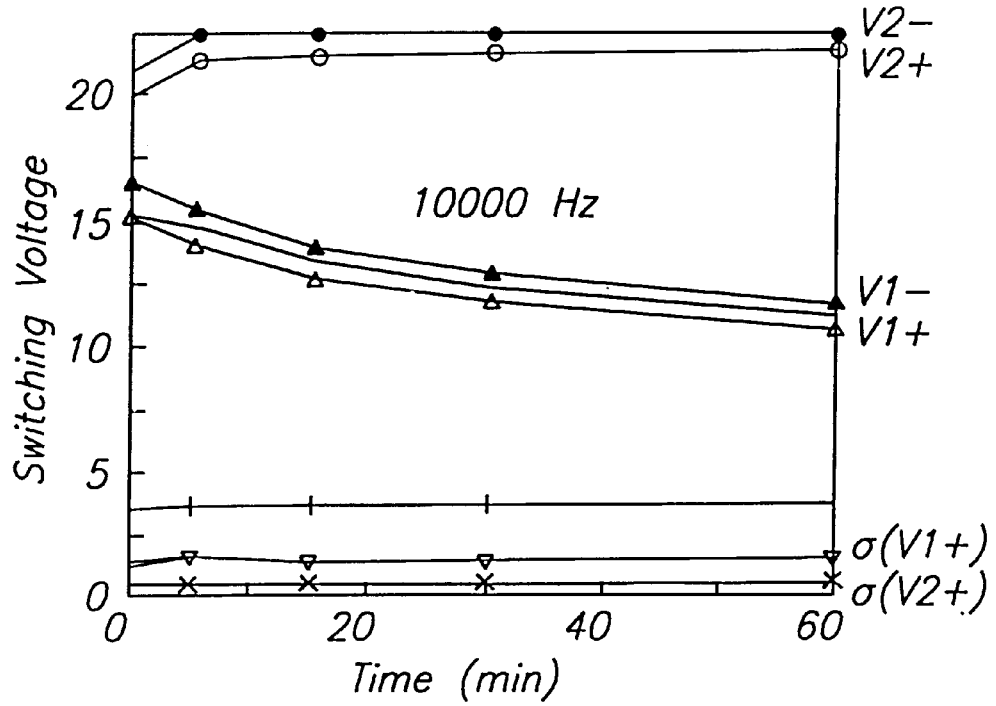
FIG. 11 is a graph representing switching voltage and release voltage for the experiment of FIG. 10.

FIG. 10 shows a light versus voltage graph for a sample GLV device having a rough bottom ribbon surface. Methanol was used as the lubricant. The GLV device of FIG. 10 had an initial hysteresis curve 150. As a result of the peening of the surface, the hysteresis curve widened as shown through a series of measurements, 152, 154, 156 and 158. FIG. 11 shows the aging improvement corresponding to the graph of FIG. 10. The switching voltage for this device $V_{2\text{-}Methanol}$ rose by several volts upon smoothing of the surfaces and the release voltage $V_{1\text{-}Methanol}$ lowered favorably.

Figure 12:
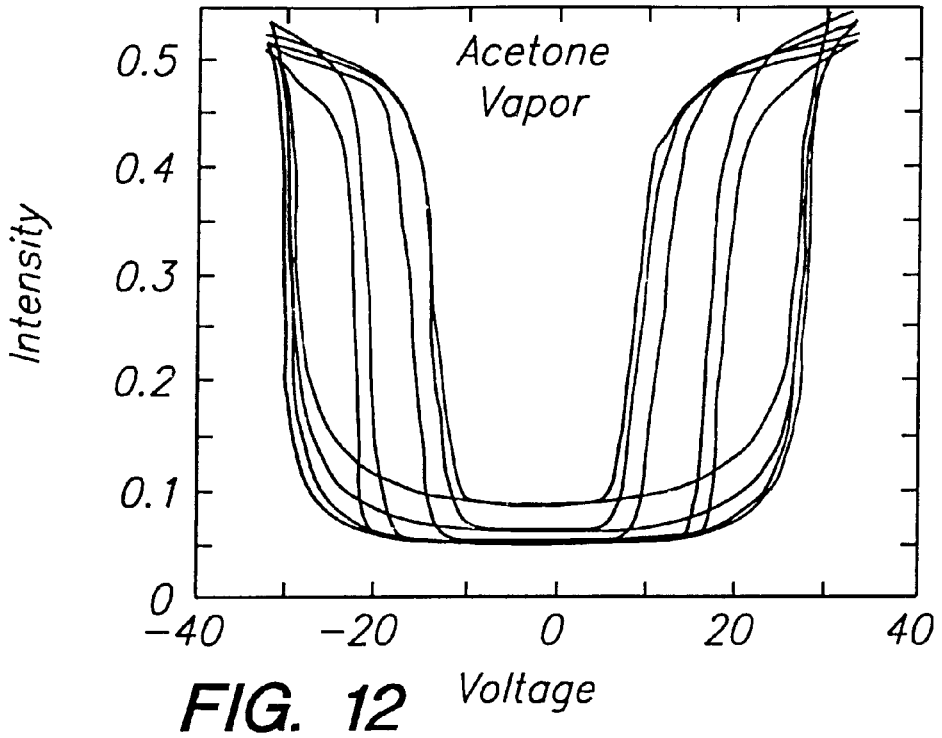
FIG. 12 is a graph representing experimental values of collected light versus voltage applied in a GLV over a course of an aging cycle with acetone as a lubricant.
Figure 13:
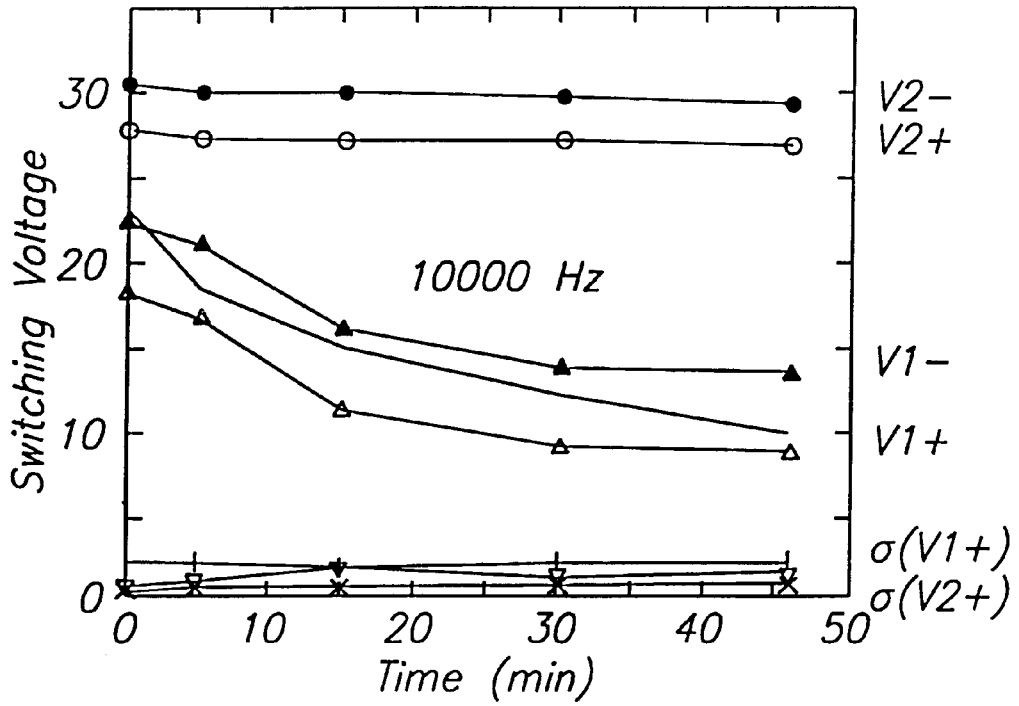
FIG. 13 is a graph representing switching voltage and release voltage for the experiment of FIG. 12.

FIG. 12 shows a light versus voltage graph for a sample GLV device having a rough bottom ribbon surface. Acetone was used as the lubricant. FIG. 13 shows the aging improvement corresponding to the graph of FIG. 12.

Figure 14:
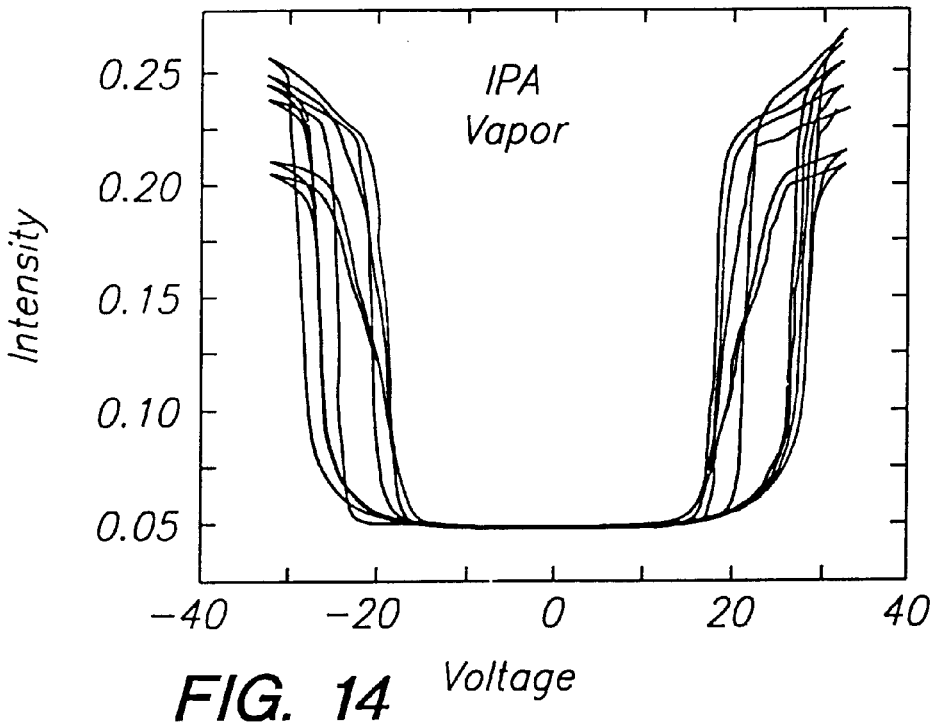
FIG. 14 is a graph representing experimental values of collected light versus voltage applied in a GLV over a course of an aging cycle with isopropanol as a lubricant.
Figure 15:
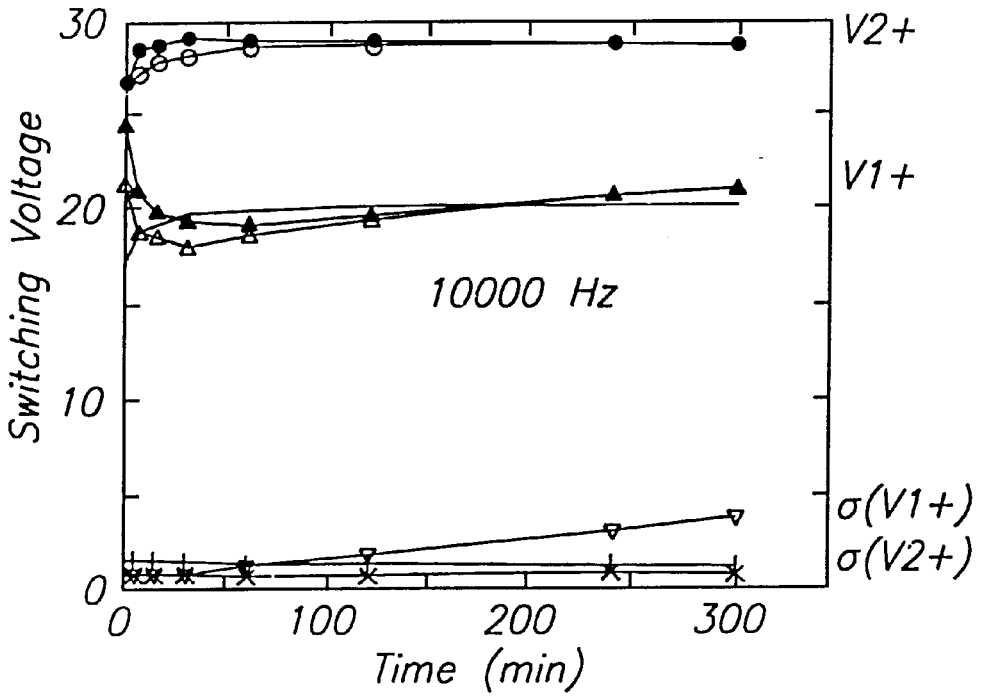
FIG. 15 is a graph representing switching voltage and release voltage for the experiment of FIG. 14.

FIG. 14 shows a light versus voltage graph for a sample GLV device having a rough bottom ribbon surface. Isopropanol was used as the lubricant. FIG. 15 shows the aging improvement corresponding to the graph of FIG. 14.

The preferred lubricants are polar low molecular weight materials. In all cases, except acetone, the materials have an OH structure. The materials that have been found to work favorably are acetone, ethanol, ethylene glycol, glycerol, isopropanol, methanol, and water. Notwithstanding, all the preferred lubricants have polarity such that they have a permanent electric dipole moment. It is theorized that the dipole in the lubricant interacts with the surface quite strongly. The dipole in the lubricant will induce an image dipole in the electrons in the surface of the micro machine structure and those two dipoles will attract one another thereby causing the lubricant to work properly.

Galden, hexane and heptane are examples of polar low molecular weight molecules that do not work as a lubricant. Galden is a trademark of Ausimont. Experimiental data shows that four different molecular weights of Galden fails to provide any effect on the aging cycle.

Figure 1:
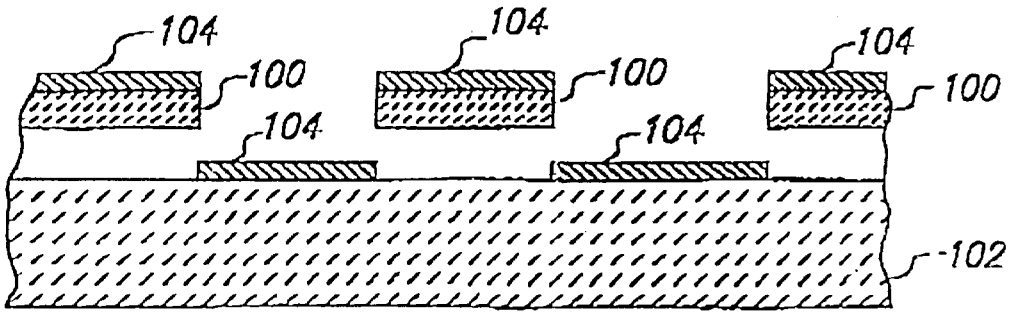
FIG. 1 (PRIOR ART)
FIG. 1 is a schematic representational cross sectional diagram of a GLV device according to the prior art wherein the diffracting ribbon is in an up and relaxed state.
Figure 2:
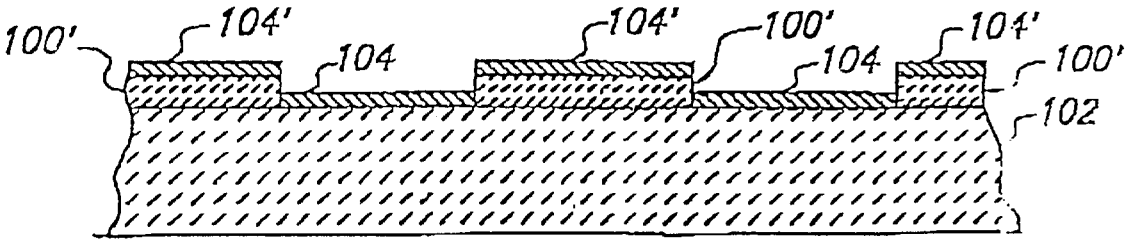
FIG. 2 (PRIOR ART)
FIG. 2 is a schematic representational cross sectional diagram of a GLV device according to the prior art wherein the diffracting ribbon is in a down and tensioned state.
Figure 3:
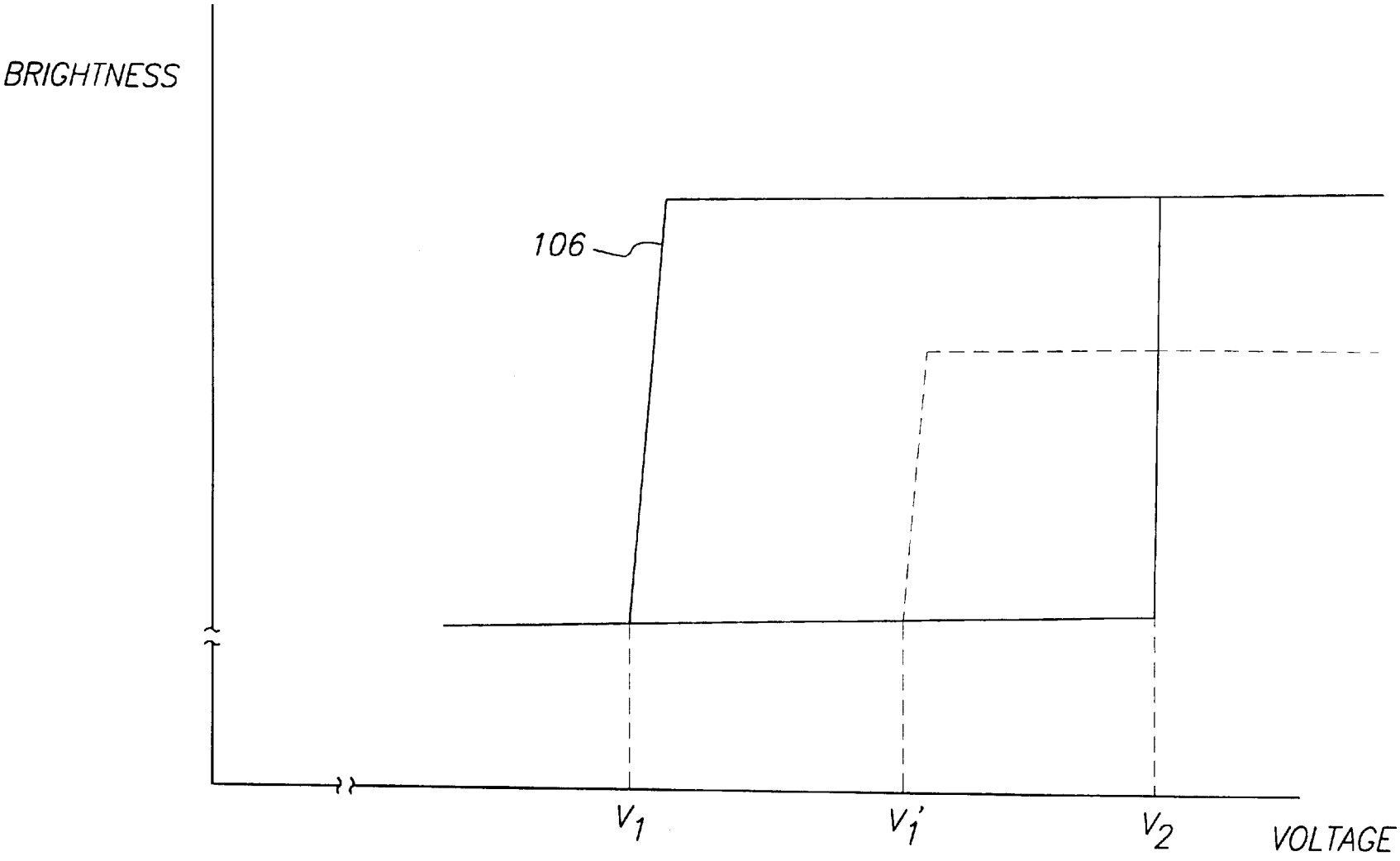
FIG. 3 is a graph representing collected light versus voltage applied in an idealized GLV.
Figure 4:
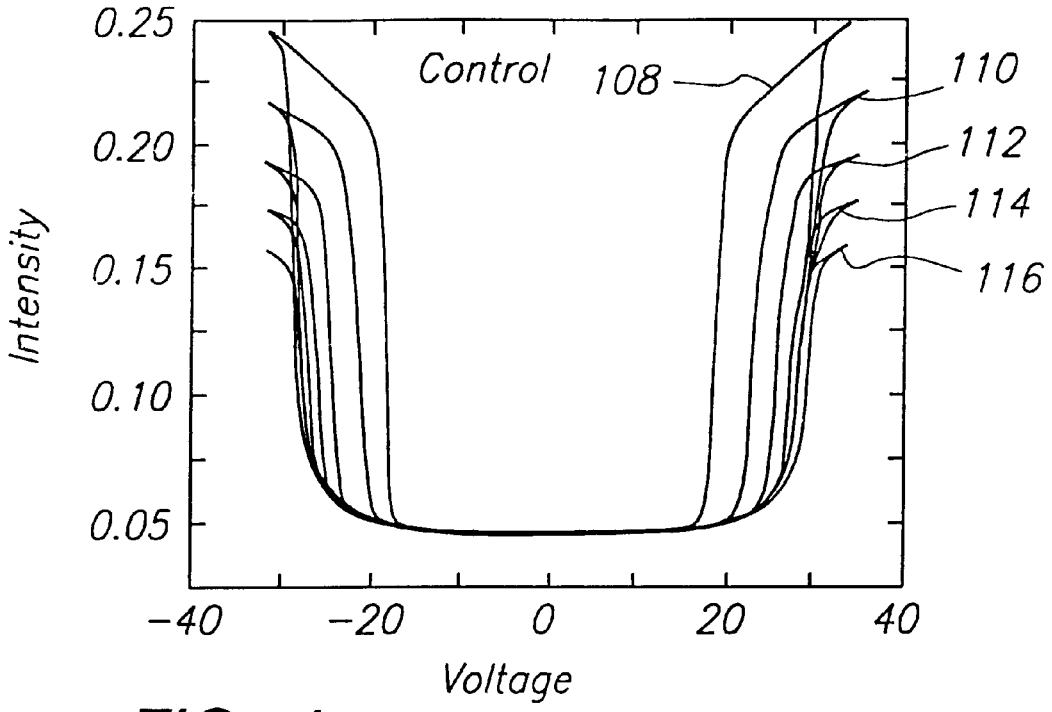
FIG. 4 is a graph representing experimental values of collected light versus voltage applied in a control GLV over a course of an aging cycle.
Figure 5:
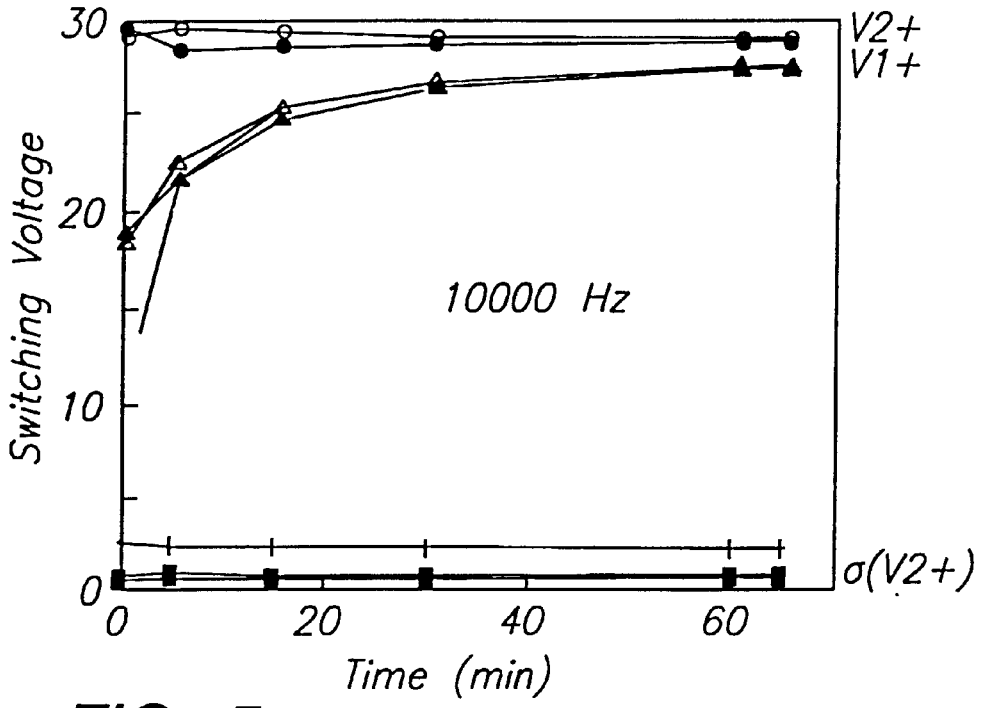
FIG. 5 is a graph representing switching voltage and release voltage for the experiment of FIG. 4.
Figure 6:
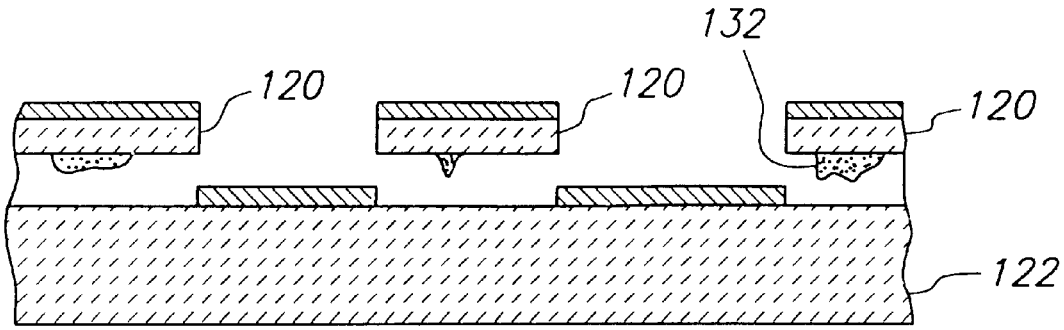
FIG. 6 is a schematic cross sectional diagram of a GLV showing irregularities formed as a result of an aging cycle performed in an ambient atmosphere.
Figure 7:
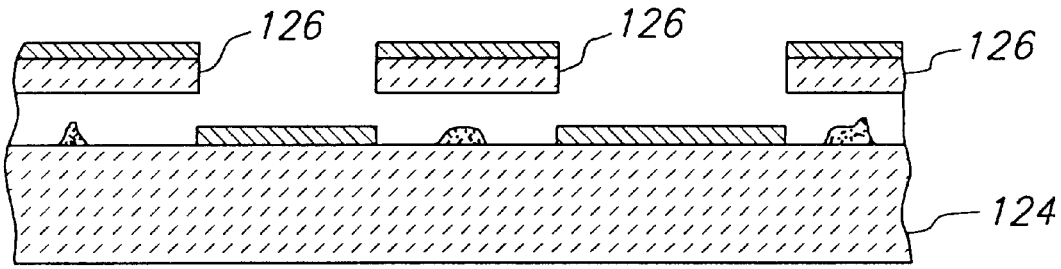
FIG. 7 is a schematic cross sectional diagram of a GLV showing irregularities formed as a result of an aging cycle performed in an ambient atmosphere.
Figure 8:
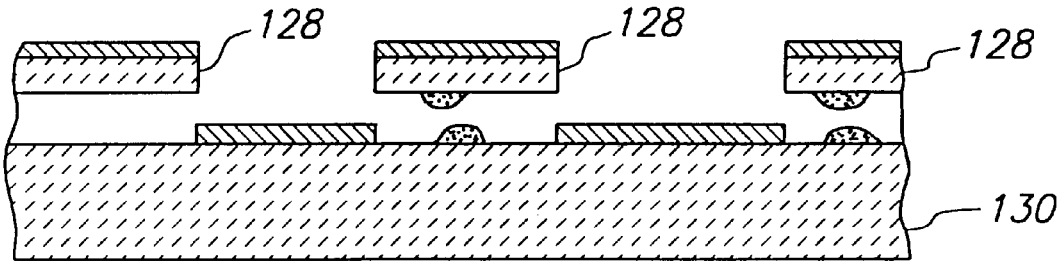
FIG. 8 is a schematic cross sectional diagram of a GLV showing irregularities formed as a result of an aging cycle performed in an ambient atmosphere.
Figure 9:
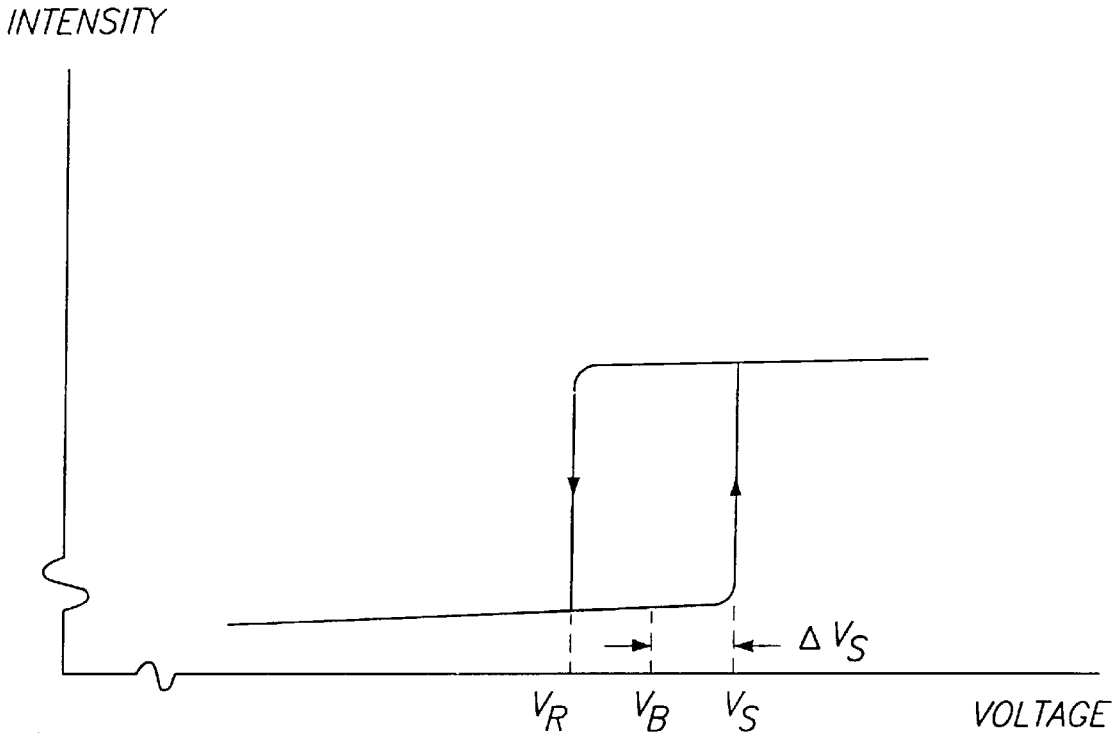
FIG. 9 shows an operating voltage graph.
Figure 16:
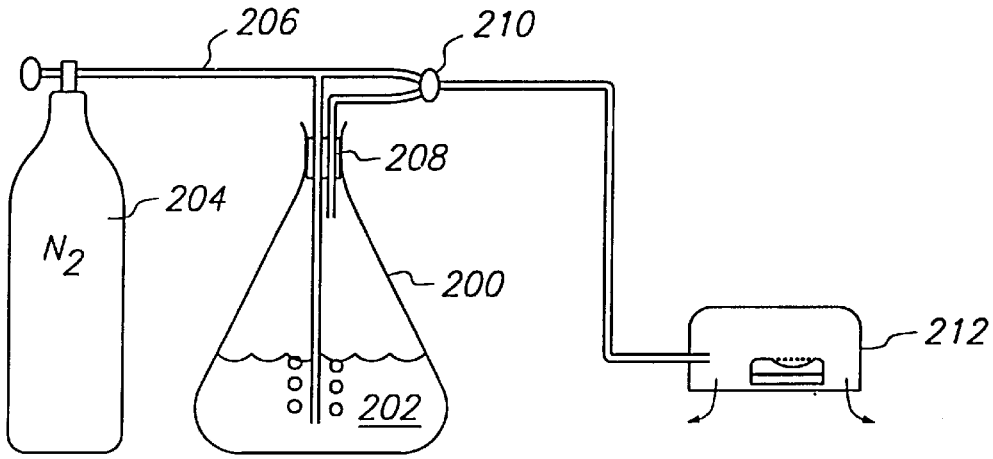
FIG. 16 is a schematic representation of the equipment for carrying out the method of applying lubricant as a vapor to a micro machine.

Other have attempted the use of lubricants on micro machine devices using liquid phase deposition of the lubricant. According to the preferred method, the lubricants are applied in the gaseous phase. The method of applying the lubricants includes bubbling an inert gas through the lubricant and then applying this combined gas to the micro machine in a sealed environment as shown in FIG. 16. Preferably the inert gas is dry nitrogen $N_2$.

A flask 200 is used to hold a liquid reservoir of the lubricant material 202. A source 204 of dry nitrogen $N_2$ gas is passed through plumbing 206 through a seal 208 to bubble through the lubricant material 202. A lubricant rich gas vapor at 100% vapor pressure passes back out of the flask 200 through the seal 208 and to a mixing valve 210 where it is mixed with dry nitrogen to a desired relative humidity of lubricant. A relative vapor pressure of as low as 8% still operates to prevent degradation of the micro machine. This is the lowest relative vapor pressure that the experimental set up could produce. The mixed gas is flowed into a vessel 212 where the device under test is operated. The gas is allowed to escape from the vessel 212 to maintain a constant relative vapor pressure. As an alternative embodiment, once the appropriate relative vapor pressure is achieved, the vessel could be hermetically sealed to maintain that vapor pressure of lubricant.

The present invention has been described relative to a preferred embodiment. Improvements or modifications that become apparent to persons of ordinary still in the art only after reading this disclosure are deemed within the spirit and scope of the application.

What is claimed is:

1. A method of lubricating a micro machine comprising the step of applying a lubricant to the micro machine wherein the lubricant is a compound having a permanent electric dipole moment.

2. The method according to claim 1 wherein the lubricant is selected from the group consisting of acetone, ethanol, ethylene glycol, glycerol, isopropanol, methanol, and water.

3. The method according to claim 1 wherein the lubricant is a vapor.

4. The method according to claim 1 wherein the lubricant is a polar low molecular weight vapor compound.

5. The method as claimed in claim 4 wherein the polar low molecular weight vapor compound is water in a gaseous physical state.

6. The method as claimed in claim 4 wherein the polar low molecular weight vapor compound is acetone in a gaseous physical state.

7. The method as claimed in claim 4 wherein the polar low molecular weight vapor compound is ethanol in a gaseous physical state.

8. The method as claimed in claim 4 wherein the polar low molecular weight vapor compound is ethylene glycol in a gaseous physical state.

9. The method as claimed in claim 4 wherein the polar low molecular weight vapor compound is glycerol in a gaseous physical state.

10. The method as claimed in claim 4 wherein the polar low molecular weight vapor compound is isopropanol in a gaseous physical state.

11. The method as claimed in claim 4 wherein the polar low molecular weight vapor compound is methanol in a gaseous physical state.

12. The method as claimed in claim 4 wherein the lubricant has a relative vapor pressure of at least 8%.

13. A method of making a micro machine comprising the steps of:

a. forming a ribbon element above a substrate wherein the ribbon element and the substrate include facing surfaces and at least one of the facing surfaces is initially a rough surface;

b. appalling a lubricant on one of the facing surfaces, wherein the lubricant is selected from the group consisting of acetone, ethanol, ethylene glycol, glycerol, isopropanol, methanol, and water; and c. smoothing the rough surface by repeatedly contacting the facing surfaces together with the lubricant between the facing surfaces.

14. A method of lubricating a micro machine comprising the steps of:

a. flowing an inert gas through a liquid reservoir of a lubricant for forming a lubricant rich gas; and b. flooding a partially sealed vessel containing the micro machine with the lubricant rich gas wherein the lubricant is a polar low molecular weight compound.

15. A method of lubricating a micro machine comprising the steps of:

a. flowing an inert gas through a liquid reservoir of a lubricant for forming a lubricant rich gas wherein the lubricant is a polar low molecular weight vapor compound;

b. combining the lubricant rich gas with an inert gas for forming a mixed gas; and c. flooding a partially sealed vessel containing the micro machine with the mixed gas.

16. A method of lubricating a micro machine comprising the steps of:

a. flowing an inert gas through a liquid reservoir of a lubricant for forming a lubricant rich gas;

b. combining the lubricant rich gas with an inert gas for forming a mixed gas;

c. flooding a vessel containing the micro machine with the mixed gas to a predetermined vapor pressure of the mixed gas, wherein the predetermined vapor pressure is at least 8%; and d. sealing the vessel to maintain the predetermined vapor pressure of the mixed gas.

17. A modulator for modulating an incident beam of light comprising:

a. a plurality of elongated elements, each element having a first end and a second end and a light reflective planar surface, wherein the elements are grouped into a first group and a second group such that the elements of the first group are interdigitated with the elements of the second group, the elements being arranged parallel to each other;

b. means for suspending the elements of the first group and the second group by their ends;

c. a substrate positioned parallel to the elongated elements;

d. means for electrically coupling all the elongated elements of the first group in each row together;

e. means for electrically coupling all the elongated elements of the second group in each row together;

f. means for applying a first bias voltage to the first group and mearns for applying a second bias voltage to the second group such that the reflective surfaces are substantially coplanar and in a first plane such that the incident beam of light is reflected;

g. means for selectively deflecting the elements of the first group perpendicular to the first plane toward a second plane which is parallel to the first plane and into contact with the substrate such that the incident beam of light is diffracted; and h. a lubricant rich vapor between the elements of the first group and the substrate.

18. The modulator according to claim 17 wherein the lubricant is selected from the group consisting of acetone, ethanol, ethylene glycol, glycerol, isopropanol, methanol, and water.

19. A micro-mechanical device for preventing degradation in performance due to welding, the device comprising:

a. a first element;

b. a second element selectively moveable relative to the first element wherein a portion of the first element is selectively in contact with a portion of the second element thereby forming a contact portion; and c. a film of a polar low molecular weight gaseous phase lubricant applied in a gaseous state to at least the contact portion.

20. The micro-mechanical device according to claim 19 wherein the lubricant is selected from the group consisting of acetone, ethanol, ethylene glycol, glycerol, isoprdpanol, methanol and water.

* * * * *

UNITED STATES PATENT AND TRADEMARK OFFICE

CERTIFICATE OF CORRECTION

PATENT NO. : 6,004,912

DATED : Dec. 21, 1999

INVENTOR(S) : Christopher Scott Gudeman

It is certified that error appears in the above-identified patent and that said Letters Patent is hereby correct as shown below:

In column 1, line 44, delete "impilnges" and insert --impinges--.

In column 6, line 64, delete "appalling" and insert --applying--.

Signed and Sealed this

Twelfth Day of September, 2000

*Attest:*

Q. TODD DICKINSON

*Attesting Officer*

*Director of Patents and Trademarks*